US005311106A

United States Patent [19]

Hazen

[11] Patent Number: 5,311,106

[45] Date of Patent: May 10, 1994

[54] PULSE WIDTH MODULATED ELECTRONIC SLOT CAR CONTROLLER

[76] Inventor: Mark E. Hazen, 1391 Ashboard Cir. SE., Palm Bay, Fla. 32909

[21] Appl. No.: 980,287

[22] Filed: Nov. 23, 1992

[51] Int. Cl.[5] ..... H02P 7/00

[52] U.S. Cl. ..... 318/269; 318/376; 388/831

[58] Field of Search ..... 318/16, 480, 696, 688, 318/375, 376, 362, 139, 803, 811, 592, 819, 829, 831, 838, 822; 307/10.1, 10.6; 273/86 B

[56] References Cited

U.S. PATENT DOCUMENTS

| | | | |
|---|---|---|---|
| 1,891,059 | 12/1932 | Rosenthal | 246/104 |
| 2,750,191 | 6/1956 | Denman | 273/86 B |
| 2,993,299 | 7/1961 | Dingee et al. | 104/300 |
| 3,384,030 | 5/1968 | Goldfarb | 273/86 B |
| 3,467,311 | 9/1969 | Ernst | 273/86 B |
| 4,143,307 | 3/1979 | Hansen et al. | 318/16 |
| 4,251,812 | 2/1981 | Okada et al. | 340/696 |
| 4,423,363 | 12/1983 | Clark et al. | 318/376 |
| 4,728,104 | 3/1988 | Cheng | 273/86 B |
| 4,843,297 | 6/1989 | Landino et al. | 318/811 |
| 5,070,283 | 12/1991 | Avitan | 318/139 |
| 5,084,658 | 1/1992 | Nielsen et al. | 318/139 |
| 5,087,865 | 2/1992 | Nelson, III | 318/139 |
| 5,126,337 | 6/1993 | Orton et al. | 318/16 |

*Primary Examiner*—Jonathan Wysocki

[57] ABSTRACT

A controller for slot cars on either or both domestic and/or commercial track. A programmable pulse width modulation circuit, using at least one integrated circuit to produce an output of variable duty cycle, is provided. This modulation circuit drives transistorized power switches to deliver a DC pulsation of same duty cycle as that of the modulator. The duty cycle is programmed with the use of a simple resistive network array mounted on a small board designed to plug into the rest of the device. Full power bypassing the modulator, transistorized power switches, and filter with another alternative, regenerative braking, are additional features. This controller is revolutionary in design replacing the old wire-wound power resistor technology with modern electronic technology offering the advantages of cool efficient operation and full programmability to match any slot car motor, track, or user.

1 Claim, 6 Drawing Sheets

PULSE WIDTH MODULATED ELECTRONIC SLOT CAR CONTROLLER

BACKGROUND OF THE INVENTION

Before a detailed discussion of this new electronic approach to slot car control is pursued, it is necessary to consider the prior art. In this way, it will become clear that the electronic controller, and the concepts it embodies, are new and unique to slot car control. The prior art embodied the use of a large wire-wound resistor that had a sliding-contact means of varying the resistance and thus the amount of current supplied to a slot car. The variable resistance is placed in series in the current path between a DC source and the track on and in which the slot car rides. Either a thumb-operated plunger or a finger-operated trigger is used to vary the resistance of the controller in order to vary the speed of the slot car. This prior art design has two main deficiencies. First, the large resistor gets very hot in use and will very frequently burn open. This requires replacement. Many elaborate schemes have been devised employing heat sinks to remove heat quickly and spare the resistor. Second, a different amount of resistance is needed to accommodate different types and classes of slot cars. These resistors range from 60 or so ohms down to less than 1 ohm of resistance. It is not uncommon for an individual to have several controllers to match different slot cars. The new design by Mark E. Hazen does not get noticeably hot and can quickly be programmed to match any car, or person's tastes, by simply replacing a "personality module".

SUMMARY

The present invention is a pulse width modulated electronic slot car controller that has a power switching means with integrating means for changing the average voltage and current supplied to a slot car used on domestic and commercial slot car tracks. What is more, it has a programmability means of changing the operating characteristics of the controller to accommodate different types of slot cars and different likes of the user. The electronic slot car controller incorporates a pulse width modulation means that is commonly used for all types of DC motor speed control. Thus, the technique itself is not unique. However, the application of it to the control of slot cars is. In pulse width modulation schemes, an electronic circuit is used to create a continuous train of DC square wave pulse whose pulse width and duty cycle can be varied. If the pulse width is long, and duty cycle high, the average voltage and current produced by the pulse train will be high. Conversely, if the duty cycle is low, the average voltage and current will be low. Because the power switching devices are being turned either completely on or completely off with the rising and falling square wave pulses, there is little or no heat generated through power dissipation. In order for heat to be generated from electrical power, current and voltage must be present at the same time. Power is the product of current and voltage. When the power switching devices are off, there is no current. When the power switching devices are full on, there is very little voltage across them. Therefore, there can be no significant power dissipation. As an example, 5 A·0 V=0 W of power and 0 A·(maximum voltage)=0 W of power. The result is an electronic controller that operates cool, requires no heat sink, and is in no danger of self-destruction through overheating. Thus, a primary object of this invention is to provide a pulse width modulation means of voltage and current control to the slot car such that the control does not get hot and is not in danger of self-destruction.

A further object of this invention is to provide a programmability means of changing the operating characteristics of the control. A small, 10-pin, plug-in "personality module" means is used to accomplish this. The personality module includes a resistor array means of creating voltage and current incremental pulse width step changes as a moving wiper arm means selects taps on the resistor array, 10 taps associated with each of the 10 pins extending from the personality module. Programmability means is provided by simply replacing said personality module with another module having a different resistor array.

Still a further object of this present invention is to provide a full-power and regenerative braking means integrated into the overall design. This is accomplished using so called micro switches, or trip-action switches, that are actuated by a moving wiper arm means on each end of its travel.

Finally, this present invention is a pulse width modulated, programmable, electronic slot car controller that has a wiper arm means of varying the duty cycle of the DC square wave voltage and current in conjunction with a resistor-array personality module that determines the rate of change in said voltage and current to suit the user and slot car type and switching means at each end of said wiper arm's travel to provide full power for maximum speed at one end of travel and regenerative braking action at the other end of travel.

REFERENCES CITED BY THE INVENTOR

U.S. Patent Documents

| | | | |
|---|---|---|---|
| 1,891,059 | 12/1932 | Rosenthal | 104/149 |
| 2,750,191 | 06/1956 | Denman | 104/149 |
| 2,993,299 | 01/1958 | Dingee/Dickinson | 46/244 |
| 3,384,030 | 05/1968 | Goldfarb | 104/60 |
| 3,467,311 | 09/1969 | Ernst | 238/10 |
| 4,728,104 | 03/1988 | Cheng | 273/86, 104/305, 446/455 |

Technical References

*Exploring Electronic Devices*, Mark E. Hazen, Saunders College Publishing, 1991; Pgs. 632 to 640 and 745 to 760, ISBN 0-03-028533-X

*Experiencing Electricity and Electronics*, Mark E. Hazen, Saunders College; Publishing, 1989, Pg. 587, ISBN 0-03-003427-2

DETAILED DESCRIPTION OF THE PREFERRED EMBODIMENT

Figure 1:
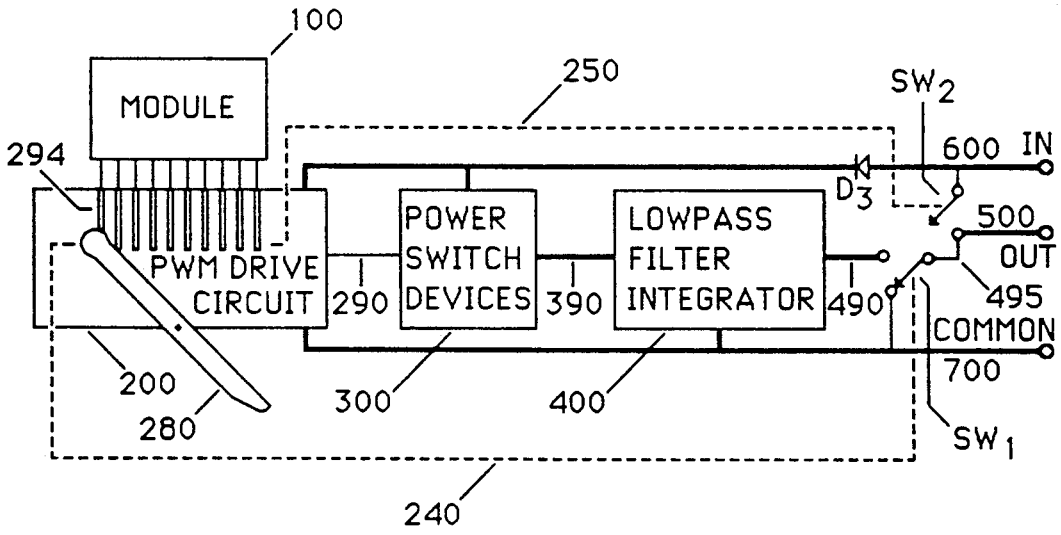
FIG. 1 is the overall block diagram of the embodiment of the present invention.
Figure 2:
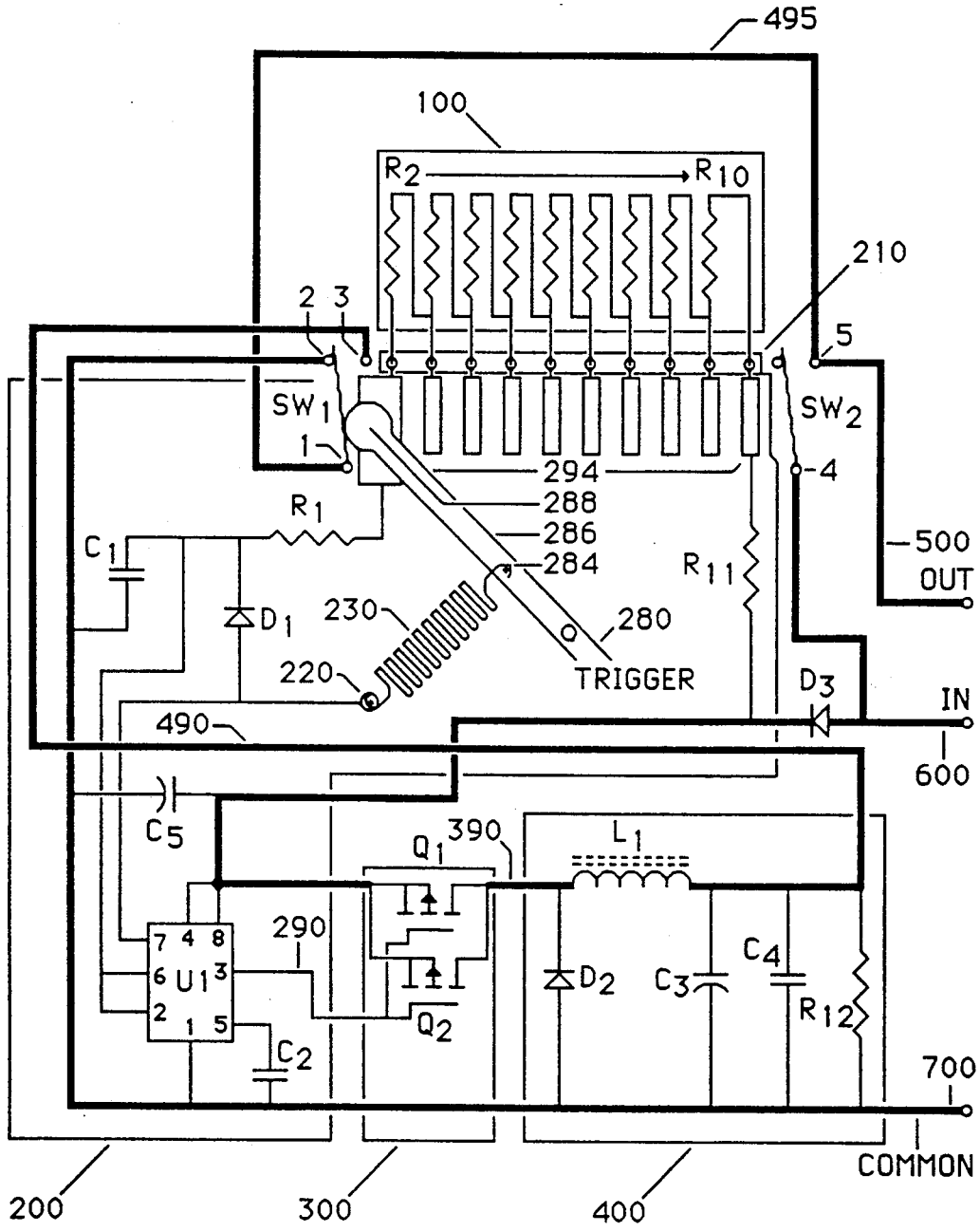
FIG. 2 is the schematic and diagrammatic showing of the preferred embodiment of the present invention incorporating all of the functional blocks shown in FIG. 1.

Referring to FIG. 1, FIG. 2, FIG. 3, and FIG. 5, the personality module at 100 is a resistor array providing programmability means that determines the step changes in pulse width modulation as the wiper arm assembly at 280 is actuated by hand. The resistors R2 to R10 are arranged structurally in parallel and electrically in series with a lead of one resistor at each series connection of resistors protruding away and beyond their circuit board as shown in detail in FIGS 5*a* and 5*b*. The pulse width modulation means at 200 is varied in duty cycle by the trigger and wiper arm assembly at 280 moving across a set of stationary printed circuit board contacts at 294 that are electrically connected to the personality module via plug/socket means, socket at 210 in FIG. 2 and FIG. 3. The personality module at 100 determines the size of the voltage and current steps that will be created as the wiper contact moves from left to right across the copper-foil stationary contact strips on the printed circuit board as shown in FIGS. 1, 2, and 4. The relative sizes of resistors $R_2$ to $R_{10}$ is the programmability means that determines these step sizes. If an even incremental change is desired, all resistors on the module will be the same value. If it is desired to have larger steps in voltage at first, then $R_2$, $R_3$, and $R_4$ will be larger than the remaining resistors, or $R_2$ may be the largest with all the rest decreasing in value. In this way, the controller can be programmed to match the skill of the user or the handling characteristics of the slot car.

Referring to FIGS. 1 and 2, the pulse width modulation means at 200 passes the varying duty cycle pulsating DC via an output line 290 which is also an input line to drive the power switching devices at 300. The power switching devices $Q_1$ and $Q_2$ are the high-speed switching means to turn the current and voltage on and off from the DC source input at 600 through reverse-voltage protection diode $D_3$ and out line 390 to the lowpass filter (integrator) at 400. The lowpass filter circuit at 400, acting as an integrator, is the means of smoothing the pulsating DC into a pure DC. The smoothed DC is passed via line 490 to lines 495 and 500 as the output via switch $SW_1$. Switch $SW_1$ is the regenerative braking means shorting the output line at 500 to the common ground line at 700 when the trigger/wiper arm assembly at 280 is in the at rest position at shown. Switch $SW_1$ is also the variable voltage output path means when assembly 280 is moved forward slightly. Switch $SW_2$ is the full-power means when assembly 280 is in the extreme forward position (to the right) actuating $SW_2$ bridging switch terminals 4 to 5 and passing the full DC source voltage and current at line 600 to line 500 and on out to the slot car track (not shown). The slot car track forms no part of this invention. Mechanical actuation lines 240 and 250 of FIG. 1 are shown to indicate that wiper arm assembly 280 is used to actuate $SW_1$ and $SW_2$.

Referring now to FIG. 2, a +VDC power source is connected to line 600 and is made available to $SW_2$ at terminal 4. When the trigger/wiper assembly at 280 is in the full-on forward position (to the right), switch terminal 4 and 5 of $SW_2$ are bridged and full voltage from 600 is passed to 500 as +VDC out. When switch $SW_1$ is in the at rest position as shown, the motor of the slot car is deliberately shorted via line 500, line 495, $SW_1$ terminals 1 and 2 bridged to line 700 to provide regenerative braking action. When the trigger/wiper assembly at 280 is in a forward position (to the right), switch $SW_1$ provides bridging of terminals 1 to 3 so the integrated and smoothed DC on line 490 can pass to the associated output at 500 via line 495. Voltage and current is supplied to the active electronic circuitry via diode $D_3$ which is the means of preventing circuit damage due to incorrectly connecting lines 600 and 700 to the power source. Capacitor $C_5$ acts as a filter/integrator on the input side of the circuitry just after $D_3$.

Referring still to FIG. 2, integrated circuit $U_1$ is the device used to create the varying duty cycle pulsating DC square wave that will drive the power switches at 300 via line 290. $U_1$ is a timing device that operates as a square wave oscillator. Capacitor $C_1$ is the timing capacitor that is charged and discharged under the control of $U_1$. The length of time it takes $C_1$ to charge determines how long line 290 is at a +VDC level and line 390 is at a low state, near 0 VDC. The length of time it takes $C_1$ to discharge determines how long line 290 is at a near 0 VDC level and line 390 is at a +VDC level. The charging path for timing capacitor $C_1$ is from +VDC at 600 through $R_{11}$ proceeding through $R_{10}$ on the personality module continuing through $R_9$ and continuing through consecutive resistors to any of the stationary contacts or 294 at which the wiper arm is contacting, which may be in any position from left to right across the stationary contacts while in use, continuing down the conductive wiper arm from 288 to 286 to 284 to the return spring at 230 to terminal post 220 continuing through $D_1$ to $C_1$ which is connected to the common ground line labeled 700. Thus, the length of time required to charge capacitor $C_1$ and to keep the power switches at 300 turned off is determined by the value of $C_1$ in microfarads and the sum of all resistances on the personality module to the right of the moving wiper contact plus $R_{11}$. The discharge path for capacitor $C_1$ is from $C_1$ to $R_1$ through the 10-pin socket to $R_2$ and consecutive ascending resistors on the personality module to the stationary contact of 294 at which the moving wiper 288 is contacting and continuing down the conductive wiper arm at 286 to 284 to the return spring at 230 to terminal 220 continuing on to pin 7 of $U_1$. A transistor internal to $U_1$ at pin 7 is used to discharge capacitor $C_1$ to ground via pin 1 of $U_1$. Thus, the length of time required to discharge capacitor $C_1$ and to keep the power switches at 300 turned on is determined by the value of $C_1$ in microfarads and the sum of all resistances on the personality module to the left of the moving wiper contact plus $R_1$. Thus, the pulse width modulation means providing varying duty cycle pulsating DC to drive $Q_1$ and $Q_2$ at 300 on and off is accomplished by the selective interaction of the moving wiper arm at 288 across the stationary contacts of 294 in conjunction with the resistors of the personality module at 100. Programming means is accomplished by carefully selecting the values of resistors $R_2$ through $R_{10}$ of the personality module so as to vary the step changes in charge and discharge time which determine the step changes of on verses off time of power switches $Q_1$ and $Q_2$ at 300 and resulting in varying duty cycle voltage and current at line 390.

Continuing in FIG. 2, inductor $L_1$ and capacitors $C_3$ and $C_4$ form a lowpass filter, or integrator, which converts the pulsating DC, supplied via $Q_1$ and $Q_2$ at 300 and line 390, to a nearly smooth DC voltage and current. Thus, the slot car's motor responds to smoothly varying DC. In other words, the output voltage and current looks the same as that which would come from a conventional resistor-type controller. Diode $D_2$ of filter/integrator block 400 provides a ground return path for current induced by collapsing magnetic fields surrounding $L_1$ during the off time with each cycle of pulsating DC at line 390. Resistor $R_{12}$ is a load resistance providing moderate damping to the filter integrator when the wiper assembly at 280 is in the left-most at rest position which leaves line 490 at terminal 3 of $SW_1$ open and otherwise unloaded.

Figure 3A:
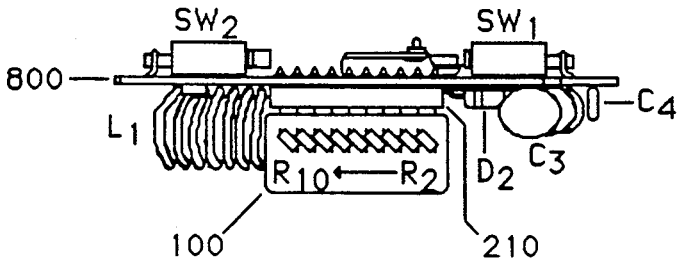
FIG. 3*a* is a top view of the preferred embodiment and FIG. 3*b* is a diagram of the component side (non-copper side) of the preferred embodiment of the present invention showing component placement and demonstrating the programmability means, the personality module.
Figure 3B:
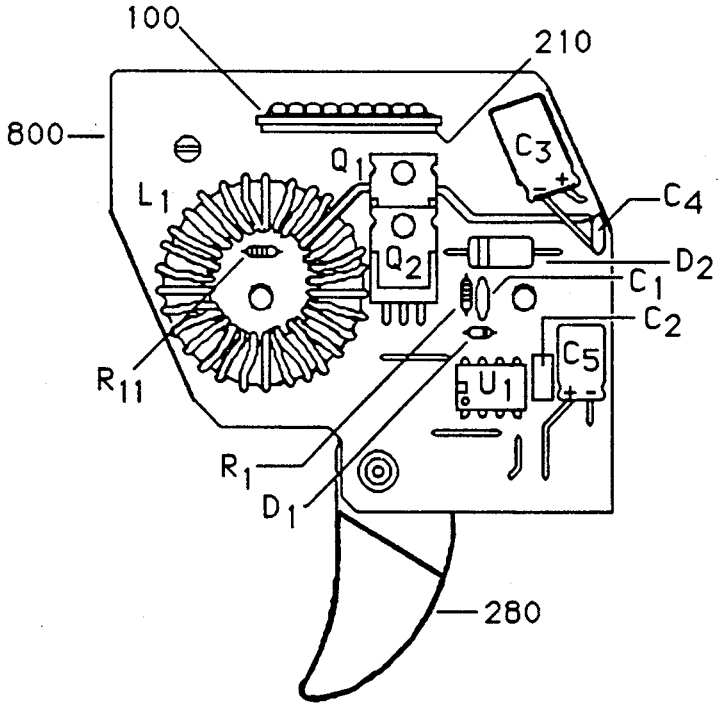
Figure 4:
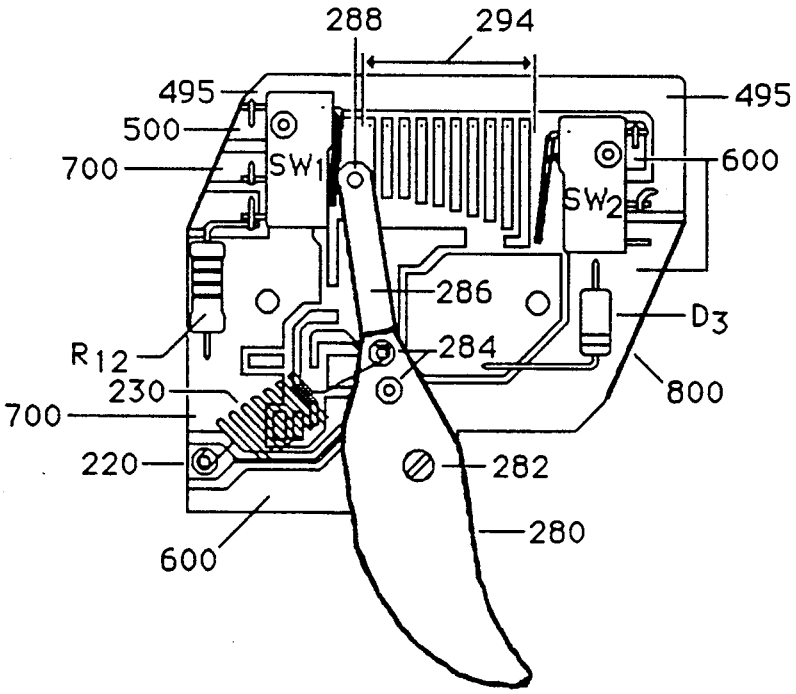
FIG. 4 is of the copper foil side of the preferred embodiment of the present invention showing the pulse width modulation variation means by moving wiper arm assembly in contact with stationary printed circuit board contacts that are electrically connected to the 10-pin socket and personality module on the reverse side of the board.
Figure 5A:
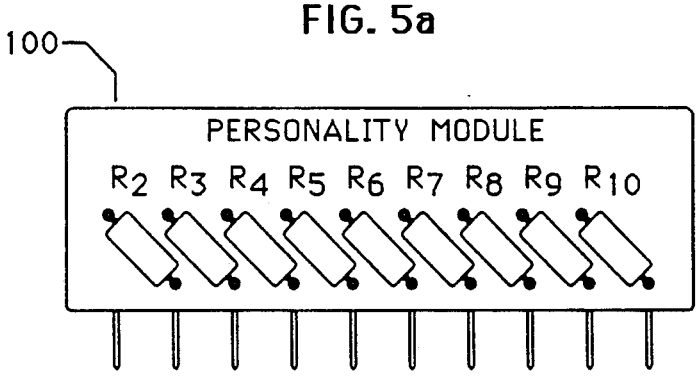
FIG. 5*a* is of the component side of the personality module and 5*b* is of the foil side of the personality module.
Figure 5B:
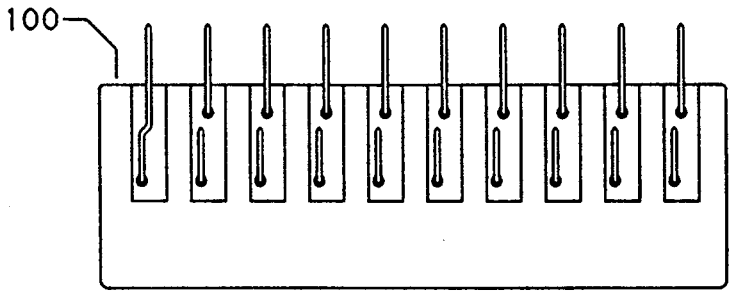

Referring now specifically to FIG. 3 the personality module programmability means is shown diagrammatically in two perspectives. FIG. 3*a* is a top view clearly showing the means of connecting the module to the main board by socket means at 210. In FIG. 3*a*, the resistor side of module 100 can be seen showing an array of oblong resistors, the modular array plugged into the receptacle. In FIG. 3*b*, a side plane view of the main board is shown with a view of module 100 inserted into socket 210. All other components have been referred to previously.

Referring specifically to FIG. 4, the relationship between wiper assembly 280, stationary contacts 294, regenerative braking switch $SW_1$, and full-power switch $SW_2$ are clearly shown. All other components have been referred to previously.

Figure 6:
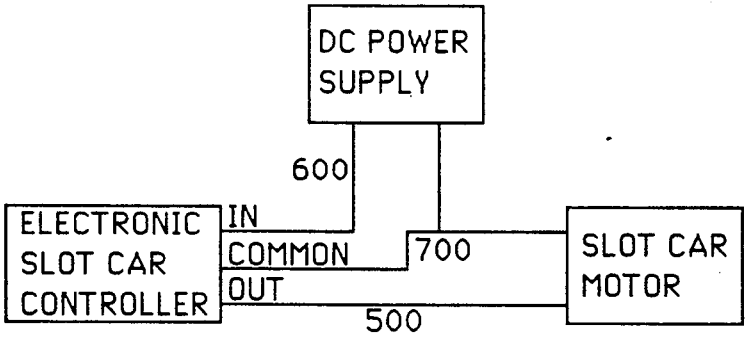
FIG. 6 is of the interconnection of the electronic slot car controller and the DC power source and the slot car motor.

Referring now to FIG. 6, the electronic slot car controller described in this specification utilizes the programmable pulse width modulation herein described to control the power applied to the slot car motor, therefore controlling its speed. As described previously, line 600 delivers power to the controller from the DC power supply, line 500 delivers controlled power to the slot car motor from the controller, and line 700 is in common to all as a current return path.

Finally, the present invention is well able to accomplish all previously stated objects and to attain all stated advantages over the prior art. While the presently preferred embodiment of this invention has been presented here for the purpose of disclosure, numerous changes in the details of construction, arrangement of parts, selection of pulse width modulation means, selection of power switching means, and programmability means will be readily apparent to anyone skilled in the art and which are encompassed within the spirit of the present invention and the scope of the following appended claims.

What I claim is:

1. A device comprising;

a programmable pulse width modulating means with a first output for varying the duty cycle of said first output, power switching means with an input for producing a second output voltage and current of same said duty cycle with said input taken from said first output, filtering means associated with a third output for smoothing to DC power said second output of said power switching means, and for sending said DC power to said third output, full power means for circumventing said pulse width modulating means, said power switching means, and filtering means, means for regenerative braking having means for shorting the third output with all said DC power simultaneously removed from said third output, plug-in module means with an array of resistors for programming of said device to have a variable level of power to said third output to accommodate any slot car motor, and whereby said programming for variability of control of power of the third output of said device may be quickly modified by exchange of said plug-in module means.

* * * * *